US008147049B2

(12) United States Patent
Korol et al.

(10) Patent No.: US 8,147,049 B2
(45) Date of Patent: Apr. 3, 2012

(54) WASTE PHASE CHANGE INK RECYCLING

(75) Inventors: Steven Van Cleve Korol, Dundee, OR (US); Steven Ross Slotto, Camas, WA (US); Britton T. Pinson, Vancouver, WA (US)

(73) Assignee: Xerox Corporation, Norwalk, CT (US)

( * ) Notice: Subject to any disclaimer, the term of this patent is extended or adjusted under 35 U.S.C. 154(b) by 760 days.

(21) Appl. No.: 12/274,721

(22) Filed: Nov. 20, 2008

(65) Prior Publication Data

US 2010/0123755 A1 May 20, 2010

(51) Int. Cl.
*B41J 2/18* (2006.01)

(52) U.S. Cl. ..... 347/90; 347/93

(58) Field of Classification Search ..... 347/90, 347/91, 93

See application file for complete search history.

(56) References Cited

U.S. PATENT DOCUMENTS 4,491,433 A 1/1985 Shiurila et al.
5,992,991 A * 11/1999 Kanemoto et al. ..... 347/88
7,048,353 B2 5/2006 Waller et al.
2004/0114006 A1 6/2004 Phillips
2005/0285917 A1 12/2005 Nichols et al.
2006/0244799 A1 11/2006 Sasa et al.
2007/0008372 A1 1/2007 Katada

FOREIGN PATENT DOCUMENTS

JP 3151247 6/1991

OTHER PUBLICATIONS

EP Search Report corresponding to European Patent Application 09175532.2, European Patent Office, Rijswijk Netherlands, Aug. 3, 2010 (6 pages).

* cited by examiner

*Primary Examiner* — Jerry Rahll
(74) *Attorney, Agent, or Firm* — Maginot, Moore & Beck, LLP

(57) ABSTRACT

A method of recycling waste phase change ink includes collecting waste phase change ink in a container in a phase change ink imaging device. The waste phase change ink comprises melted phase change ink emitted by at least one print head in the phase change ink imaging device. The collected waste phase change ink is removed from the phase change ink imaging device, and at least a portion of the collected waste phase change ink removed from the imaging device is added to a quantity of melted phase change ink.

14 Claims, 7 Drawing Sheets

WASTE PHASE CHANGE INK RECYCLING

CROSS-REFERENCE TO RELATED APPLICATIONS

Reference is made to commonly-assigned copending U.S. patent application Ser. No. 12/274,903 entitled "Waste Phase Change Ink Recycling" to Slotto et al., filed concurrently herewith, the entire disclosure of which is expressly incorporated by reference herein.

TECHNICAL FIELD

This disclosure relates generally to phase change ink imaging devices, and, and, in particular, to the handling of waste ink in phase change ink imaging devices.

BACKGROUND

In general, ink jet printing machines or printers include at least one printhead that ejects drops or jets of liquid ink onto a recording or image forming media. A phase change ink jet printer employs phase change inks that are solid at ambient temperature, but transition to a liquid phase at an elevated temperature. The molten ink can then be ejected onto a printing media by a printhead directly onto an image receiving substrate, or indirectly onto an intermediate imaging member before the image is transferred to an image receiving substrate. Once the ejected ink is on the image receiving substrate, the ink droplets quickly solidify to form an image.

In various modes of operation, ink may be purged from the printheads to ensure proper operation of the printhead. When a solid ink printer is initially turned on, the solid ink is melted or remelted and purged through the printhead to clear the printhead of any solidified ink. The word "printer" as used herein encompasses any apparatus, such as digital copier, bookmaking machine, facsimile machine, multi-function machine, etc. that performs a print outputting function for any purpose. When ink is purged through the printhead, the ink flows down and off the face of the printhead typically to a waste ink tray or container positioned below the printhead where the waste ink is allowed to cool and re-solidify. The waste ink collection container is typically positioned in a location conveniently accessible so that the container may be removed and the waste ink discarded.

SUMMARY

As an alternative to discarding or disposing of waste phase change ink that is collected in a phase change ink imaging device, a method of reusing or recycling the waste phase change ink has been developed. In one embodiment, the method of recycling waste phase change ink includes collecting waste phase change ink in a container in a phase change ink imaging device. The waste phase change ink comprises melted phase change ink emitted by at least one print head in the phase change ink imaging device. The collected waste phase change ink is removed from the phase change ink imaging device, and at least a portion of the collected waste phase change ink removed from the imaging device is added to a quantity of melted phase change ink.

In another embodiment, a method of recycling phase change ink comprises purging melted phase through at least one print head in a phase change ink imaging device; collecting the purged phase change ink in a container in the phase change ink imaging device; removing the collected waste phase change ink from the phase change ink imaging device; and adding at least a portion of the collected waste phase change ink removed from the imaging device to a quantity of melted phase change ink.

BRIEF DESCRIPTION OF THE DRAWINGS

The foregoing aspects and other features of the radiant heating unit and web heating systems incorporating radiant heating units are explained in the following description, taken in connection with the accompanying drawings, wherein.

DETAILED DESCRIPTION

Figure 1:
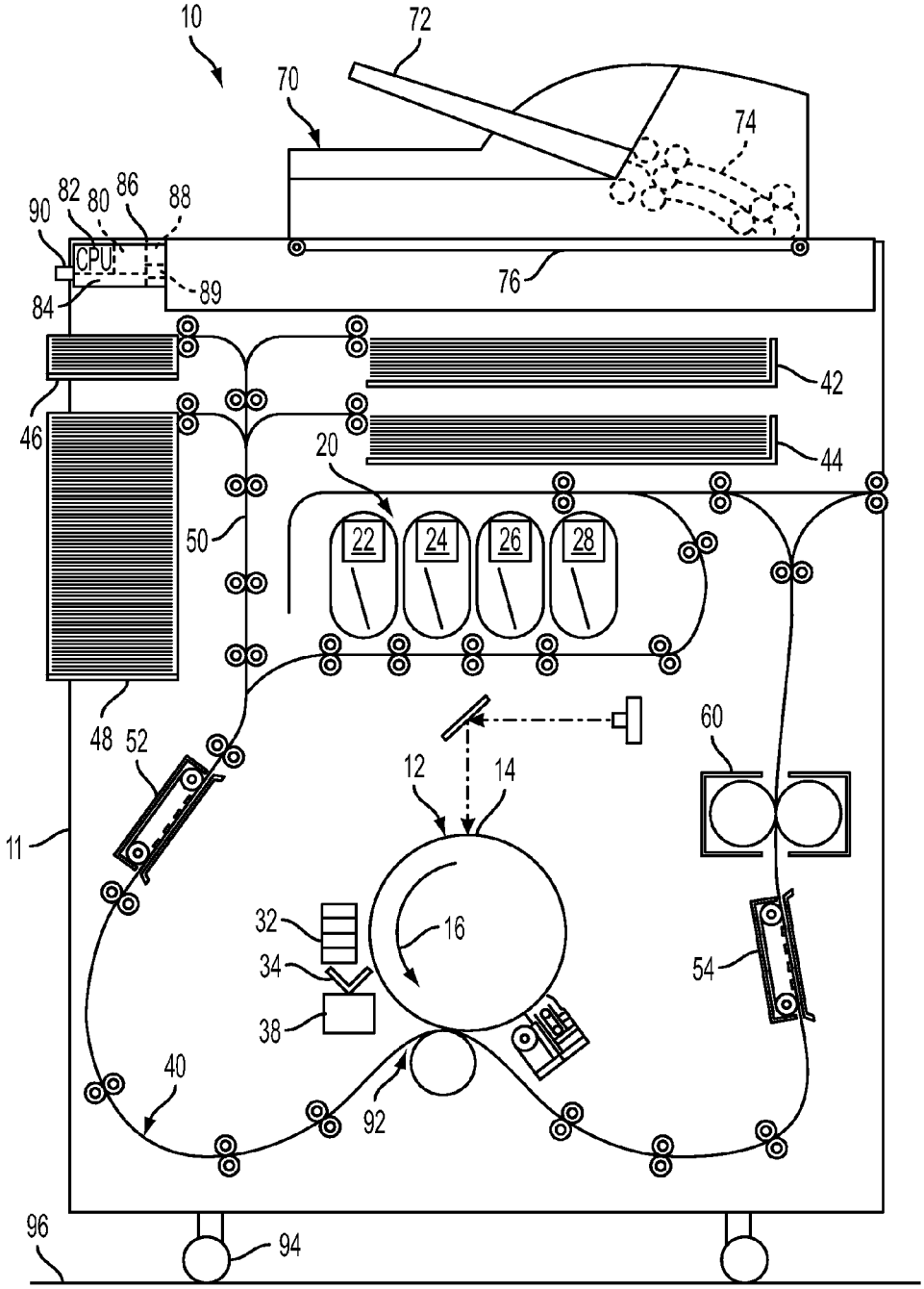
FIG. 1 is block diagram of a phase change ink image producing machine.

For a general understanding of the present embodiments, reference is made to the drawings. In the drawings, like reference numerals have been used throughout to designate like elements.

As used herein, the term "imaging device" generally refers to a device for applying an image to print media. "Print media" can be a physical sheet of paper, plastic, or other suitable physical print media substrate for images, whether precut or web fed. The imaging device may include a variety of other components, such as finishers, paper feeders, and the like, and may be embodied as a copier, printer, or a multi-function machine. A "print job" or "document" is normally a set of related sheets, usually one or more collated copy sets copied from a set of original print job sheets or electronic document page images, from a particular user, or otherwise related. An image generally may include information in electronic form which is to be rendered on the print media by the marking engine and may include text, graphics, pictures, and the like.

Referring now to FIG. 1, there is illustrated an image producing machine, such as the high-speed phase change ink image producing machine or printer 10 of the present invention. As illustrated, the machine 10 includes a frame 11 to which are mounted directly or indirectly all its operating subsystems and components, as will be described below. To start, the high-speed phase change ink image producing machine or printer 10 includes an imaging member 12 that is shown in the form of a drum, but can equally be in the form of a supported endless belt. The imaging member 12 has an imaging surface 14 that is movable in the direction 16, and on which phase change ink images are formed.

The machine 10 includes a phase change ink system 20 that has at least one source 22 of one color phase change ink in solid form, referred to herein as ink sticks. An ink stick may take many forms. As illustrated, the machine 10 is a multi-color image producing machine, and the ink system 20 includes, e.g., four (4) sources 22, 24, 26, 28, representing four (4) different colors of phase change inks, e.g., CYMK (cyan, yellow, magenta, black). The phase change ink system 20 also includes a phase change ink melting and control assembly (not shown) for melting or phase changing the solid form of the phase change ink into a liquid form. Phase change ink is typically solid at room temperature. The ink melting assembly is configured to heat the phase change ink to a melting temperature selected to phase change or melt the solid ink to its liquid or melted form. Currently, common phase change inks are typically heated to about 100° C. to 140° C. to melt the solid ink for delivery to the printhead(s).

Thereafter, the phase change ink melting and control assembly then controls and supplies the molten liquid form of the ink towards a printhead system including at least one printhead or printhead assembly 32. Suitably, for a four (4) color multicolor image producing machine, the printhead system includes four (4) separate printhead assemblies, i.e., one for each color. However, for simplicity only one printhead assembly 32 is shown. Optionally, any suitable number of printheads or printhead assemblies may be employed.

As further shown, the phase change ink image producing machine or printer 10 includes a substrate supply and handling system 40. The substrate supply and handling system 40 for example may include substrate supply sources 42, 44, 46, 48, of which supply source 48 for example is a high capacity paper supply or feeder for storing and supplying image receiving substrates in the form of cut sheets for example. The substrate supply and handling system 40 in any case includes a substrate handling and treatment system 50 that has a substrate pre-heater 52, substrate and image heater 54, and a fusing device 60. The phase change ink image producing machine or printer 10 as shown may also include an original document feeder 70 that has a document holding tray 72, document sheet feeding and retrieval devices 74, and a document exposure and scanning system 76.

Operation and control of the various subsystems, components and functions of the machine or printer 10 are performed with the aid of a controller or electronic subsystem (ESS) 80. The ESS or controller 80 for example is a self-contained, dedicated mini-computer having a central processor unit (CPU) 82, electronic storage 84, and a display or user interface (UI) 86. The ESS or controller 80 for example includes sensor input and control means 88 as well as a pixel placement and control means 89. In addition the CPU 82 reads, captures, prepares and manages the image data flow between image input sources such as the scanning system 76, or an online or a work station connection 90, and the printhead assemblies 32. As such, the ESS or controller 80 is the main multi-tasking processor for operating and controlling all of the other machine subsystems and functions, including the machine's printing operations.

In operation, image data for an image to be produced is sent to the controller 80 from either the scanning system 76 or via the online or work station connection 90 for processing and output to the printhead assemblies 32. Additionally, the controller determines and/or accepts related subsystem and component controls, for example from operator inputs via the user interface 86, and accordingly executes such controls. As a result, appropriate color solid forms of phase change ink are melted and delivered to the printhead assemblies. Additionally, pixel placement control is exercised relative to the imaging surface 14 thus forming desired images per such image data, and receiving substrates are supplied by anyone of the sources 42, 44, 46, 48 and handled by means 50 in timed registration with image formation on the surface 14. Finally, the image is transferred within the transfer nip 92, from the surface 14 onto the receiving substrate for subsequent fusing at fusing device 60.

Figure 2:
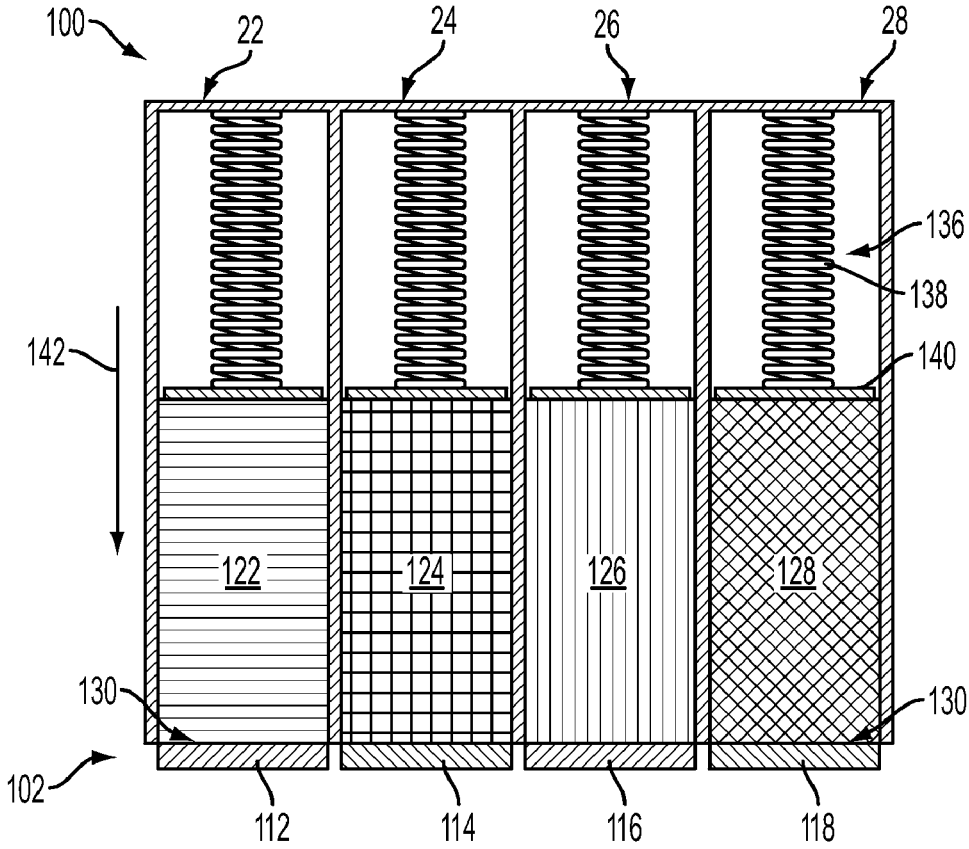
FIG. 2 is top view of four ink sources and a melter assembly having four melter plates.
Figure 3:
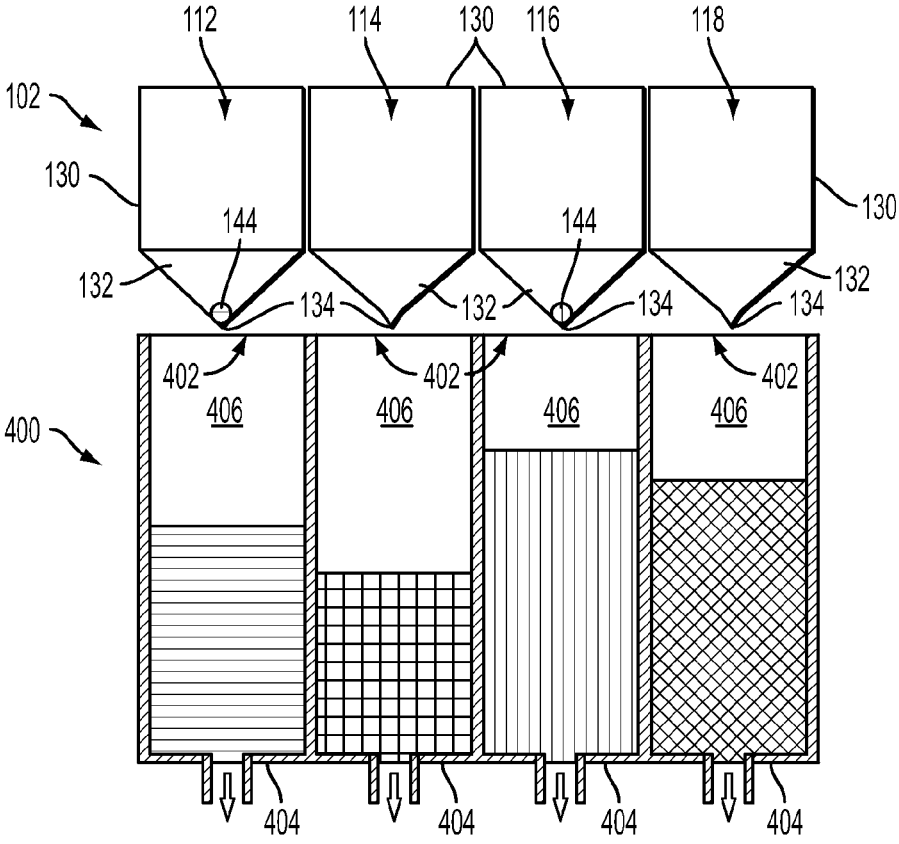
FIG. 3 is front side view of the four melter plates and the ink melting and control assembly.

Referring now to FIGS. 2 and 3, there is shown the ink delivery system 100 (FIG. 2) and ink storage and supply assembly 400 (FIG. 3) of the imaging device. The ink delivery system 100 of the present example includes four ink sources 22, 24, 26, 28, each holding solid ink sticks of a different color. However, the ink delivery system 100 may include any suitable number of ink sources, each capable of holding a different phase change ink in solid form. The different solid inks are referred to herein by their colors as CYMK, including cyan 122, yellow 124, magenta 126, and black 128. Each ink source can include a housing (not shown) for storing solid ink sticks separately from the others. The solid inks are typically in block form as depicted in FIG. 2, though the solid phase change ink may be in other formats, including but not limited to, pellets and granules, among others.

The ink delivery system 100 includes a melter assembly, shown generally at 102. The melter assembly 102 includes a melter, such as a melter plate, connected to the ink source for melting the solid phase change ink into the liquid phase. In the example provided herein, the melter assembly 102 includes four melter plates, 112, 114, 116, 118 each corresponding to a separate ink source 22, 24, 26 and 28 respectively, and connected thereto. As shown in FIG. 3, each melter plate 112, 114, 116, 118 includes an ink contact portion 130 and a drip point portion 132 extending below the ink contact portion and terminating in a drip point 134 at the lowest end. The drip point portion 132 can be a narrowing portion terminating in the drip point.

The melter plates 112, 114, 116, 118 can be formed of a thermally conductive material, such as metal, among others, that is heated in a known manner. In one embodiment, solid phase change ink is heated to about 100° C. to 140° C. to melt the phase change ink to liquid form for supplying to the liquid ink storage and supply assembly 400. As each color ink melts, the ink adheres to its corresponding melter plate 112, 114, 116 118, and gravity moves the liquid ink down to the drip point 134 which is disposed lower than the contact portion. The liquid phase change ink then drips from the drip point 134 in drops shown at 144. The melted ink from the melters may be directed gravitationally or by other means to the ink storage and supply assembly 400. The ink storage and supply system 400 includes reservoirs 404 configured to hold quantities of melted ink from the corresponding ink sources/melters and to communicate the melted ink to one or more printheads (not shown) as needed. Each reservoir 404 of the ink storage and supply system 400 includes an opening 402 positioned below the corresponding melt plate configured to receive the melted ink and a chamber 406 below the opening configured to hold a volume of the melted ink received from the corresponding melt plate.

Figure 4:
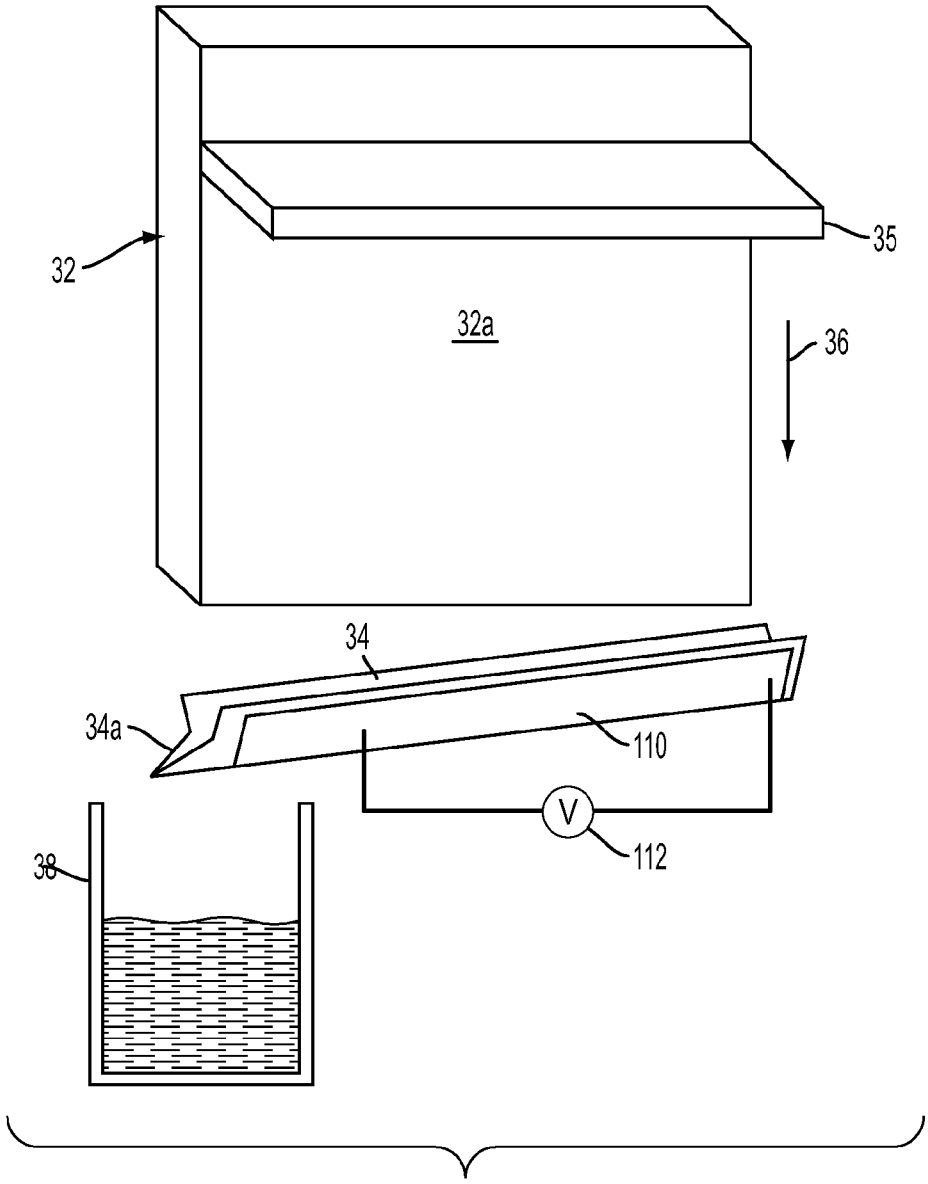
FIG. 4 is a diagrammatic illustration showing an exemplary waste ink disposal system.

With reference now to FIGS. 1 and 4, the imaging device includes trough or gutter 34 positioned below the ink ejecting face 32*a* of the printhead assembly 32. Optionally, a scraper or wiper blade 35 is drawn across (e.g., in the direction indicated by the arrow 36) the ink ejecting face 32*a* of the printhead 32 to squeegee away any excess liquid phase ink that may collect there. The waste ink wiped-off or otherwise removed from the face of the printhead (typically, still in liquid from) is caught by the gutter 34 which ultimately channels or otherwise directs it toward a removable waste ink collection container 38 where, e.g., it is allowed to cool and re-solidify. Suitably, the waste ink collection container 38 is positioned in a location conveniently accessible, e.g., at or near the outside of the main housing 11 of the machine 10. Accordingly, when full, the container 38 is readily removed for disposal of the waste ink from the container. Alternately, the full container 38 may simply be disposed of and replaced with a new empty container.

As an alternative to disposing of the waste ink of the imaging device, the present disclosure proposes directly reusing or recycling the waste ink by adding the waste ink back into an ink supply. As used herein, waste ink refers to ink that has passed through a printhead of an imaging device that has not been deposited onto a print substrate. For example, waste ink may be ink that has been purged or flushed through a printhead or ink that has collected on the nozzle plate of printheads during imaging operations. In one embodiment, the waste ink is collected and added back into a black ink supply. Waste ink may be added directly to the black ink supply because purged ink of different colors collected in a common waste ink container, such as the container 38 described above, results in a mixture of inks in the container having a color that is approximately black. Accordingly, the waste ink may be added to the black ink in limited quantities without noticeably affecting print quality of black ink, e.g., black optical density.

Figure 5:
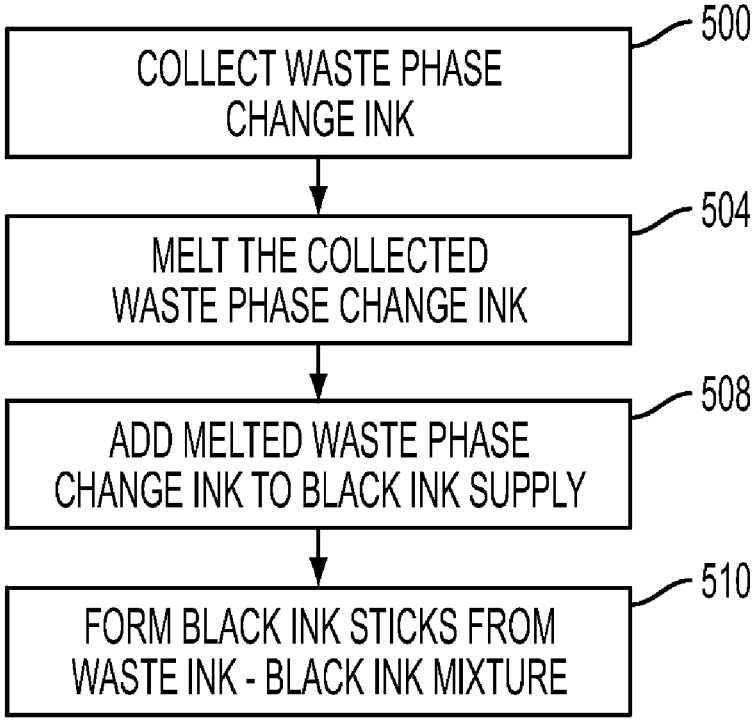
FIG. 5 is a flow chart of a method of recycling waste phase change ink.

In one embodiment, waste ink recycling may take place at an ink manufacturing site where the waste ink may be added into the black ink supply at some point prior to the formation of black ink sticks. FIG. 5 depicts one embodiment of a method of recycling waste phase change ink in which the waste ink is added to the black ink supply at the ink manufacturing site. In this embodiment, a waste ink container such as the one 38 described above may be utilized collect the waste ink produced by an imaging device (block 500). A printer operator such as a customer, service technician, etc. can remove the waste ink container from the imaging device and return the waste ink container, or at least the waste ink contained therein, to the factory for recycling (block 504). The waste phase change ink is then heated to a phase change ink melting temperature in order to melt the waste phase change ink into liquid form (block 504). As mentioned above, the melting temperature may be about 100° C. to 140° C.

A quantity of the melted waste phase change ink is then added to a supply of melted black phase change ink (block 508) such that the resulting ink mixture has no more than a predetermined percentage of waste ink relative to unused, or "fresh," ink in the mixture. As used herein, unused or fresh ink refers to ink that has not been passed through a printhead of an imaging device. The percentage or ratio of waste ink to fresh ink in the mixture may be any suitable ratio. Acceptable percentages of waste ink to fresh ink may be dependent upon factors such as ink formulation, the amount of black ink printing versus color printing, customer need, etc. In one embodiment, the quantity of the melted waste phase change ink that may be added to a supply of melted black ink is such that the resulting ink mixture has no more than 25% waste ink relative to unused, or "fresh," ink. The percentage of waste ink in the ink mixture, however, may be more or less than 25%.

Once the melted waste phase change ink has been added to the melted black phase change ink supply according to a predetermined ratio, the combination of waste ink and black ink may be mixed to form a recycled ink mixture. The recycled ink mixture may then be supplied to an ink stick formation system that is configured to form solid ink sticks from the recycled ink mixture (block 510). The ink sticks composed of the recycled ink mixture may be formed in the same manner as conventional ink sticks such as injection molding, compression molding, formed tub and flow fill, extrusion and shaping, etc.

The waste ink may be filtered to remove gross contaminants from the ink such as paper debris and dust at any suitable point during the recycling process. For example, the ink may be filtered before adding the ink to the black ink supply. When the ink recycling is performed at a factory or manufacturing site, the waste ink may be added to the black ink supply at any point prior to final filtration of the ink. By adding the waste phase change ink supply to the black ink supply during the manufacturing process, quality of the mixed ink may be determined using measurement quality assurance systems already in place.

Figure 6:
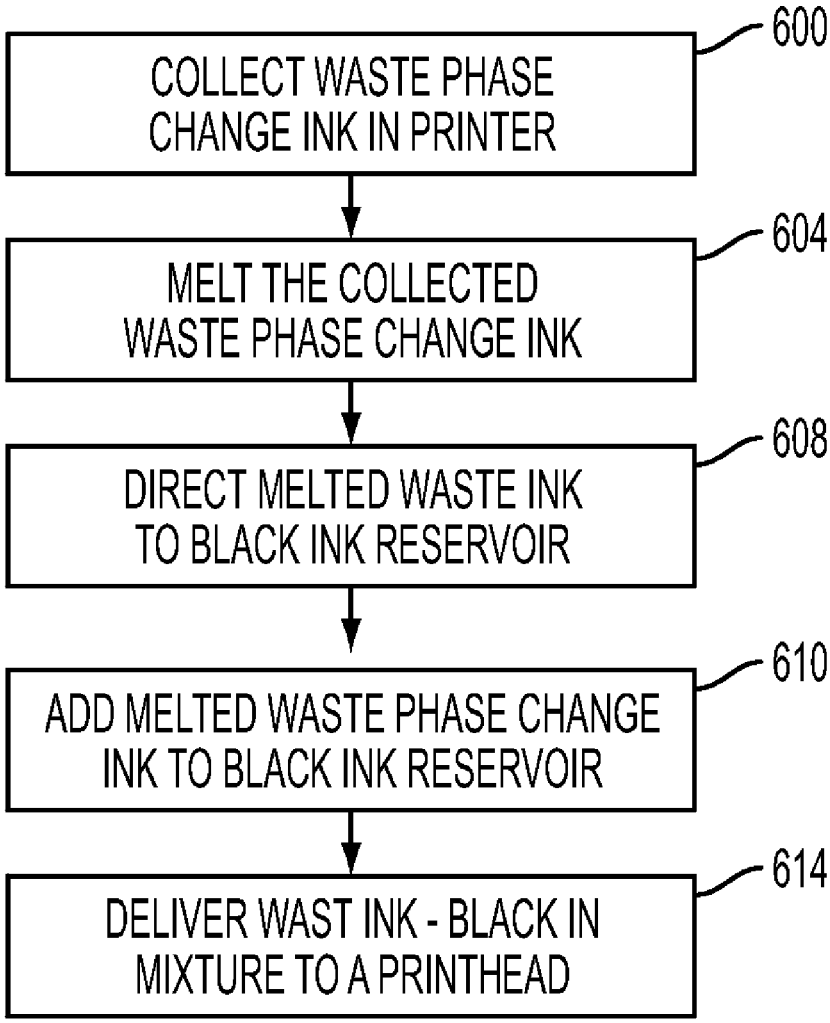
FIG. 6 is a flow chart of another method of recycling waste phase change ink.

As an alternative to recycling ink at an ink manufacturing site, the imaging device may be equipped with a waste ink recycling system that enables the waste ink to automatically be reused in the imaging device without requiring user interaction. FIG. 6 depicts one embodiment of a method of recycling waste phase change ink in which the waste ink is added to the black ink supply directly in the imaging device. Similar to the method of FIG. 5, waste ink from the imaging device is first collected such as by a gutter and waste ink supply container system (block 600). Instead of removing a waste ink container from the imaging device and delivering waste ink to a manufacturing site where the waste ink may be added to the black ink supply during the black ink manufacturing process, the collected waste ink is heated to a phase change ink melting temperature in order to melt the waste ink or to maintain the waste phase change ink in liquid form (block 604). As mentioned above, the melting temperature may be about 100° C. to 140° C. The waste ink in the method of FIG. 6 is then directed to the black ink supply, e.g., black ink reservoir, in the imaging device (block 608), and a quantity of the melted waste phase change ink is added to a black ink printhead reservoir (block 610) such that the resulting ink in the black ink reservoir has no more than a predetermined percentage of waste ink received from the waste ink container relative to melted black ink received from the ink melting assembly. As mentioned, the percentage or ratio of waste ink to fresh ink in the mixture may be any suitable ratio. In one embodiment, the quantity of the melted waste phase change ink that may be added to a supply of melted black ink is such that the resulting ink mixture in the reservoir has no more than 25% waste ink relative to unused, or "fresh," ink. The percentage of waste ink in the ink mixture, however, may be more or less than 25%. The reservoir is heated in a suitable manner to maintain the mix of waste ink and black ink in the reservoir in melted or liquid form for delivery as needed to one or more black ink printheads (block 614).

Figure 7:
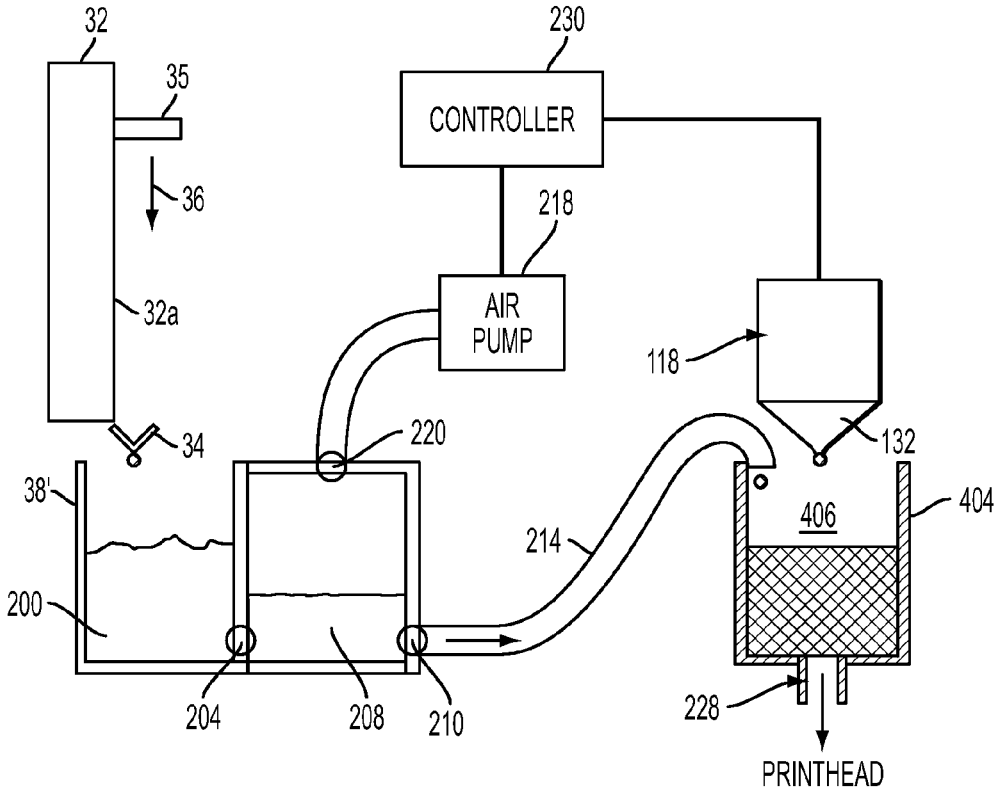
FIG. 7 is a schematic diagram of a system for recycling waste phase change ink directly in a phase change ink imaging device.

FIG. 7 depicts an embodiment of waste ink recycling systems that may be incorporated into the imaging device and configured to implement the method of FIG. 6. Similar to FIG. 3, the system of FIG. 7 includes a trough or gutter 34 positioned below the ink ejecting face 32*a* of the printhead assembly 32. A scraper or wiper blade 35 may be drawn across (e.g., in the direction indicated by the arrow 36) the ink ejecting face 32*a* of the printhead 32 to squeegee away any excess liquid phase ink that may collect there. The waste ink wiped-off or otherwise removed from the face of the printhead (typically, still in molten or melted form) is caught by the gutter 34.

Instead of directing the melted toward a removable waste ink container as described above in connection with FIG. 4, the gutter 34 of FIG. 7 is configured to direct waste ink to a waste ink container chamber that includes a dispensing system for directing or delivering melted waste phase change ink to the black ink reservoir. The waste ink container may comprise a container similar to the one described above. In alternative embodiments, the waste ink container may comprise a sump chamber that is incorporated at a bottom of the print head, for example. The black ink reservoir includes a chamber for receiving quantities of melted waste phase change ink from the gutter 34 as well as quantities of melted black phase change ink from the black ink melting assembly 118. An opening is positioned above the chamber 406 through which the melted phase change ink is delivered into the chamber 406. The melting assembly 118 is configured to melt black solid ink sticks and direct the melted ink to the chamber of the reservoir. The black ink reservoir 404 is configured to maintain a quantity of mixed black and waste phase change ink in liquid or melted form and to communicate the melted ink to one or more printheads as needed through at least one opening 228 in the reservoir.

In one embodiment, the waste ink supply container 38' includes a primary waste ink reservoir 200 that is positioned to receive waste ink delivered from the gutter 34. The primary waste ink reservoir 200 includes an opening 204 at or near a bottom portion of the reservoir 200 through which ink may flow to a corresponding secondary waste ink reservoir 208. Gravity, or liquid ink height, may serve as the driving force for causing the molten ink to exit the primary reservoir through the opening and into the secondary reservoir 208. To prevent backflow of waste ink from the secondary reservoir 208 to the primary reservoir 200, the opening 204 may be provided with a one-way check valve that permits ink to flow gravitationally from the primary reservoir into the secondary reservoir 208 while preventing backflow from the secondary reservoir to the primary reservoir.

The secondary reservoir 208 includes at least one discharge outlet 210 through which molten ink may flow to an ink pathway, such as a conduit or tube 214, for directing ink to the black ink reservoir 404. The system includes a dispensing system for controllably delivering measured quantities of waste ink from the secondary reservoir to the black ink reservoir via discharge outlet and ink conduit. In one embodiment, pressure is applied to the melted waste ink in the secondary reservoir 208 using, for example, an air pump 218 through a dosing valve 220 or other suitable pressurization means to causing the ink to discharge through the discharge outlet. The discharge outlet 210 may include a check valve or other suitable backflow prevention means that is configured to open to permit the flow of molten ink from the secondary reservoir to the black ink reservoir when the secondary reservoir is pressurized while preventing backflow of the ink through the opening 210 back into the secondary reservoir 208.

The system includes one or more filters positioned at various locations for filtering gross contaminants from the waste ink such as paper debris and dust. In one embodiment, a filter 224 is positioned in the opening above the chamber 406 of the black ink reservoir 404 to filter gross contaminants from the waste ink that is added to the black ink reservoir as well as to filter the black ink that is added to the reservoir from the black ink melting assembly. Additional or alternative filters may be positioned in one or more of the openings in the waste ink supply container.

The waste ink recycling system of FIG. 7 may include a waste ink recycling controller 230. The waste ink recycling controller 230 is configured to control the waste ink dispensing system 218 and the black ink melting assembly 118 in order to control the proportion or ratio of waste ink to black ink contained in the black ink reservoir. For example, the controller may be programmed with the flow rates of the inks from the waste ink reservoir and from the ink melting to the black ink reservoir so that the quantities of the inks that are dispensed into the black ink reservoir may be accurately controlled. The controller is configured to control power to the waste ink dispenser, e.g., air pump, and black ink melting assembly so that the resulting ink mixture in the black ink reservoir has no more than a predetermined percentage of waste ink relative to black ink in the chamber. The percentage or ratio of waste ink to fresh ink in the mixture may be any suitable ratio. In one embodiment, the controller 230 is configured to ensure that the quantity of the melted waste phase change added to the mixing chamber results in an ink mixture of waste ink and black ink that has no more than 25% waste ink relative to the black ink. The proportion or ratio of waste ink to black ink delivered to the mixing chamber, however, may be any suitable proportion or ratio.

Although an air pump dispensing system has been described, any suitable method of controllably dispensing waste ink from the waste ink collector into the black ink reservoir may be used. For example, as an alternative to the air pump system described above, a heated sump system may be utilized to pump melted waste ink into the black ink reservoir. In another embodiment, a gutter system may be utilized to direct the melted waste ink directly to the black ink reservoir without collecting the waste ink in a waste ink supply container.

The systems and methods described above are directed primarily to directing waste phase change ink collected in an imaging device back into a supply of melted black phase change ink. However, in alternative embodiments, waste ink may be directed to any suitable supply of ink. For example, an imaging device may include dedicated printheads for each color of ink. In this embodiment, a separate waste ink collection container may be provided for each color of ink, e.g., a cyan waste ink container, a magenta waste ink container, a yellow waste ink container, and a black waste ink container. The different colors of waste ink may then be added in controlled amounts to the appropriately colored supply of ink, e.g., waste cyan ink to the cyan ink supply. The waste ink may be added to the ink supply at a manufacturing site or directly into the ink supply in an appropriately equipped imaging device, as described above.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. A method of recycling phase change ink, the method comprising:

collecting waste phase change ink in a container in a phase change ink imaging device, the waste phase change ink comprising melted phase change ink emitted by at least one print head in the phase change ink imaging device;

removing the collected waste phase change ink from the phase change ink imaging device; and adding at least a portion of the collected waste phase change ink removed from the imaging device to a quantity of melted phase change ink.

2. The method of claim 1, the addition of the collected phase change ink further comprising:

heating the collected waste phase change ink to a phase change ink melting temperature to melt the collected and removed phase change ink into liquid form.

3. The method of claim 2, the addition of the collected phase change ink further comprising:

adding the collected waste phase change ink to a quantity of melted black phase change ink.

4. The method of claim 3, the addition of the collected and removed phase change ink to the quantity of melted black phase change ink further comprising:

adding the collected waste phase change ink to the quantity of melted black phase change ink to form an ink mixture having at most a predetermined percentage of waste phase change ink relative to black phase change ink.

5. The method of claim 4, the predetermined percentage comprising approximately 25%.

6. The method of claim 5, further comprising:

forming at least one solid ink stick from the ink mixture.

7. The method of claim 6, further comprising:

filtering at least one of the collected waste phase change ink and the ink mixture at least once to remove gross contaminants from the waste phase change ink prior to forming the at least one ink stick.

8. A method of recycling phase change ink, the method comprising:

purging melted phase change ink through at least one print head in a phase change ink imaging device;

collecting the purged phase change ink in a container in the phase change ink imaging device;

removing the collected waste phase change ink from the phase change ink imaging device; and adding at least a portion of the collected waste phase change ink removed from the imaging device to a quantity of melted phase change ink.

9. The method of claim 8, the addition of the collected phase change ink further comprising:

heating the collected waste phase change ink to a phase change ink melting temperature to melt the collected and removed phase change ink into liquid form.

10. The method of claim 9, the addition of the collected phase change ink further comprising:

adding the collected waste phase change ink to a quantity of melted black phase change ink.

11. The method of claim 10, the addition of the collected and removed phase change ink to the quantity of melted black phase change ink further comprising:

adding the collected waste phase change ink to the quantity of melted black phase change ink to form an ink mixture having at most a predetermined percentage of waste phase change ink relative to black phase change ink.

12. The method of claim 11, the predetermined percentage comprising approximately 25%.

13. The method of claim 12, further comprising:

forming at least one solid ink stick from the ink mixture.

14. The method of claim 13, further comprising:

filtering at least one of the collected waste phase change ink and the ink mixture at least once to remove gross contaminants from the waste phase change ink prior to forming the at least one ink stick.

* * * * *